US008887962B2

(12) United States Patent
Herivel et al.

(10) Patent No.: US 8,887,962 B2
(45) Date of Patent: Nov. 18, 2014

(54) DISPOSABLE HYDRATION POUCH

(76) Inventors: Gregory Ellis Herivel, Thornton, CO (US); Jeffrey Brooks Goodner, Highlands Ranch, CO (US)

( * ) Notice: Subject to any disclaimer, the term of this patent is extended or adjusted under 35 U.S.C. 154(b) by 0 days.

(21) Appl. No.: 13/315,990

(22) Filed: Dec. 9, 2011

(65) Prior Publication Data

US 2013/0146161 A1 Jun. 13, 2013

(51) Int. Cl.
*B67D 7/84* (2010.01)

(52) U.S. Cl.
USPC ..... 222/175; 222/95; 383/68; 224/148.4

(58) Field of Classification Search
CPC ..... A45F 3/20; A45F 2003/166; A45F 3/04
USPC ..... 222/175, 107, 94, 95, 526–529, 105; 224/101; 383/35, 38
See application file for complete search history.

(56) References Cited

U.S. PATENT DOCUMENTS

| | | | | |
|---|---|---|---|---|
| 2,041,515 | A | 3/1935 | Richards | |
| 3,164,151 | A * | 1/1965 | Vere Nicoll | 602/18 |
| 5,806,726 | A * | 9/1998 | Ho | 222/529 |
| 5,816,457 | A | 10/1998 | Croft | |
| 5,941,640 | A | 8/1999 | Thatcher | |
| 7,073,688 | B2 | 7/2006 | Choi et al. | |
| 7,311,231 | B2 | 12/2007 | Noell et al. | |
| 7,565,987 | B2 | 7/2009 | Bauer | |
| 7,648,276 | B2 * | 1/2010 | Gill | 383/68 |
| 7,806,300 | B1 * | 10/2010 | Noell et al. | 222/175 |
| D668,345 | S * | 10/2012 | Baumwald | D24/206 |
| 2004/0238571 | A1 * | 12/2004 | Noell et al. | 222/175 |
| 2005/0035130 | A1 * | 2/2005 | Forsman et al. | 220/705 |
| 2005/0072804 | A1 * | 4/2005 | Brown | 222/175 |
| 2006/0027611 | A1 | 2/2006 | Hobbs | |
| 2006/0038028 | A1 | 2/2006 | Miller et al. | |
| 2006/0071006 | A1 | 4/2006 | Lojkutz et al. | |
| 2006/0151534 | A1 * | 7/2006 | Mares | 222/175 |
| 2006/0163284 | A1 * | 7/2006 | Karl et al. | 222/175 |
| 2006/0231561 | A1 * | 10/2006 | Choi et al. | 220/714 |
| 2007/0012733 | A1 * | 1/2007 | Horito et al. | 224/148.2 |
| 2009/0212081 | A1 * | 8/2009 | Liang et al. | 224/148.2 |
| 2010/0127007 | A1 | 5/2010 | Dodgen | |
| 2011/0101050 | A1 * | 5/2011 | Parazynski et al. | 224/148.2 |
| 2011/0132932 | A1 * | 6/2011 | Duran | 222/175 |

* cited by examiner

*Primary Examiner* — Paul R Durand
*Assistant Examiner* — Jeremy W Carroll
(74) *Attorney, Agent, or Firm* — John A. Arsenault; Daniel M. Dubuisson

(57) ABSTRACT

An improved disposable hydration pouch and method of delivery is disclosed herein. The hydration pouch may be manufactured from poly-ethylene or other high self-friction polymers that can be thermally sealed, which allows the pouch to be inexpensive to manufacture and disposable. The hydration pouch also includes a plurality of latitudinal thermally sealed baffles to provide improved lateral support and strength while holding liquids during use over existing poly-ethylene hydration pouches in the prior art. The disposable hydration pouch may be used by athletes, hikers, cyclists, travelers, and more as a portable hydration source.

5 Claims, 4 Drawing Sheets

DISPOSABLE HYDRATION POUCH

STATEMENT REGARDING FEDERALLY SPONSORED RESEARCH AND DEVELOPMENT

Not Applicable.

FIELD OF THE INVENTION

This invention relates to portable and disposable hydration systems, particularly passive hydration pouches relying on a reservoir or containment area to deliver liquids to a user during an outdoor activity wherein liquids may not be immediately available, such as cycling, skiing, hunting, or hiking.

DISCUSSION OF RELATED ART

With the ever-increasing popularity of events such as hiking, snowboarding, downhill mountain biking, and other outdoor strenuous endurance activities, an efficient means to carry and deliver liquids to active participants is needed so that they can maintain sufficient hydration when performing those activities. Because the aforementioned outdoor activities often occur in remote locations, outdoor enthusiasts seek portable hydration pouches to improve their endurance.

Prior to the popularity of hydration pouches, athletes relied on water or other liquid bottles for hydration. Using a more solid and rigid plastic, water bottles were inflexible and rigid compared to the flexible hydration pouch system. Hydration pouch systems are increasingly popular amongst outdoor athletes because they can store a much larger volume of liquid than a traditional water bottle. Moreover, hydration pouches are easier for an athlete to access during activity compared to bottle-based systems.

Hydration pouches commonly comprise a bladder or pouch with liquids that can be stored on a person or bag and are accessed via an elongated tube connected to the pouch at one end and to a closure valve at the other end wherein a person can intake liquids from the pouch. A popular class of hydration pouches provides a bladder unit filled with liquids to be placed in a backpack or along the body, wherein the wearer can consume the liquids held in the bladder unit via a tube or hose running from the base of the hydration pouch and bite valve to the mouth of the wearer. Examples of such hydration pouch systems include U.S. Pat. Nos. 4,420,097, 5,941,640, 7,820,946, 7,806,300, and 7,975,880.

Unfortunately, hydration pouches such as those described above still have several issues. First, hydration pouches in the prior art suffer from buildup of bacteria and other pathogens such as mold because certain areas are difficult to clean as well as adequately dry. The openings of several hydration pouches in the prior art do not provide an easily accessible area where one could adequately clean all areas of the inner bladder. The inlets and outlets of most prior art devices are too small for most cleaning tools to easily access without piercing the bladder. Unfortunately, after numerous uses without proper cleaning, bacteria and other microorganisms can buildup along the inner lining of the hydration pouch increasing the likelihood a user could fall ill. Because hydration pouches are fairly expensive, they are not replaced as frequently as they should be replaced.

It is also difficult to remove trace amounts of other liquids stored previously in a hydration pouch. Popular electrolyte drinks include a variety of flavors consumed by outdoor athletes. The taste and flavors of electrolyte and other drinks are noticeable long after cleaning the inside of a hydration pouch in the prior art. The challenge in removing certain flavors and tastes from a hydration pouch is an issue with pouches in the prior art. A disposable hydration pouch would overcome this limitation; however, hydration pouches in the prior art are not intended to be disposable and are cost prohibitive to treat as such.

Further, most popular hydration pouches in the prior art do not provide a means to prevent excess lateral movement of liquids during use. The excess movement creates noise and requires energy to stabilize, which may inhibit the activity or can make carrying the hydration pouch uncomfortable for the user.

Thus, there is a need for an improved portable hydration pouch system that is disposable and affordable with sufficient means to protect against excess lateral movement of liquids. Such an improved hydration pouch should be inexpensive to manufacture, recyclable, and can securely hold one or more liters of liquid at a time.

Therefore, there is a need for an improved portable and disposable hydration pouch that is also inexpensive to manufacture. The present invention accomplishes these objectives.

SUMMARY OF THE INVENTION

The present device is a disposable hydration pouch made from thermally sealable poly-ethylene, poly-urethane, urethane, and/or other polymers.

It is an object of the present invention to provide a hydration pouch that can be easily and inexpensively manufactured.

It is an object of the present invention to provide a hydration pouch that can be easily disposed of by a user.

It is another object of the present invention to provide a hydration pouch system that can be supported from any backpack designed to carry and deliver liquids.

It is another object of the present invention to provide a hydration pouch that can store a large volume of liquid but also with specifically placed baffles to reduce excess lateral movement of liquids stored in the pouch during use.

As will be discussed in more detail, the focus of the present invention is to provide a disposable hydration pouch that is more affordable to users than hydration pouches in the prior art. The apparatus and methods discussed herein can apply to any size or shapes that may be disclosed herein and are not limited to this Description.

Other features and advantages of the present invention will become apparent from the following more detailed description, taken in conjunction with the accompanying drawings, which illustrate, by way of example, the principles of the invention.

DESCRIPTION OF THE DRAWINGS

The exemplary embodiments of this invention will be described in detail, with reference to the following Figures, wherein similar reference numbers shall refer to similar parts throughout the several views.

DETAILED DESCRIPTION OF THE PREFERRED EMBODIMENT

Illustrative embodiments of the invention are described below in the accompanying Figures. The following detailed description provides detailed schematics for a thorough understanding of and an enabling description for these embodiments. One having ordinary skill in the art will understand that the invention may be practiced without certain details. In other instances, well-known structures and functions have not been shown or described in detail to avoid unnecessarily obscuring the description of the embodiments.

Also, it is noted that as used herein and in the appended claims, the singular forms, "a," "and," "said," and "the" include plural references unless the context clearly states to the contrary. Conversely, it is also contemplated that the claims disclosed herein may be drafted as to require singular elements or exclude any optional element indicated to be so here in the accompanying text or drawings. This statement is to serve as an antecedent basis for the use of exclusive terminology as "solely," "only" and similar terms in connection with the recitation of claims elements or the use of a "negative" claim limitation(s).

Further, for clarification purposes, the embodiments of the present invention will be described with reference to the terms "reservoir," "hydration pouch," "delivery tube," "bag," "hose," "tube," and are used to provide a basic understanding of the operation of the systems, methods, and apparatuses of this invention. Thus, the terms "reservoir," "hydration pouch," "delivery tube," "bag," "hose," and "tube" should not be construed as limiting in any way the systems, methods, and apparatuses of this invention.

Figure 1:
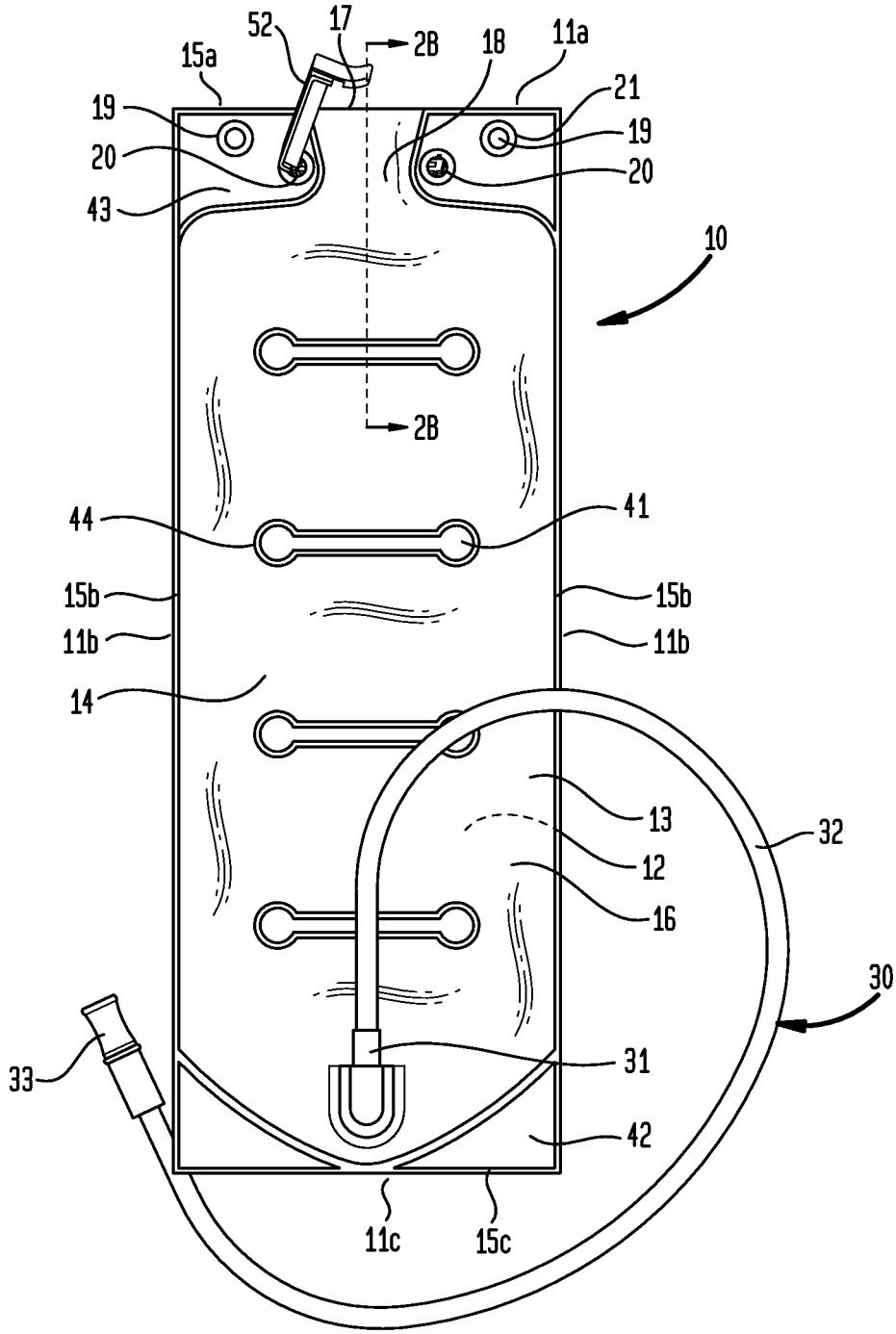
FIG. 1 is a front view of an unfilled disposable hydration pouch.

With reference to FIG. 1, a front view of an unfilled disposable hydration pouch is shown. Generally speaking the hydration pouch is generally referred to in 10 and resembles a rectangular shape when unfilled. The initial components to form the hydration pouch include a first 12 and second 13 sheet of plastic or other polymer material and then placing one flat over the other and creating a sealed and bonded perimeter as shown in 15*a*-15*c* around part of the top 11*a* of the first 12 and second 13 sheets, the lateral sides 11*b* of the sheets, and the bottom 11*c* of the sheets. After the bonded 15(*a*)-15(*c*) perimeter around the 12 first and second 13 sheets has been formed, an upper baffle 42 seal and a lower baffle 43 seal are created as shown in FIG. 1.

Suitable materials for the sheets include but are not limited to poly-ethylene, poly-propylene, poly-urethane, and urethane. Any polymers with a high self-friction will achieve the desired goal of ensuring that both sheets continually engage one another prior to being filled. Although the ideal embodiment of the invention includes bonding the sheets together via a heat sealer, the inventors imagine that any number of bonding methods including ultrasonic welders, adhesives, or other commercially practicable methods may be used.

Once the first 12 and second 13 sheets are bonded to one another at a portion of the top 11*a*, all of the lateral sides 11*b* and bottom 11*c* to form a perimeter, the basic body 14 of the hydration pouch 10 is in place. A plurality of equidistant inner baffles 41 are placed in the middle of the body 14 and runs generally horizontally or along a latitudinal axis. The inner baffles 41 are arranged parallel to the top 11*a* and bottom 11*c* of the sheets equidistant from each other, and are formed between the first 12 and second 13 sheets via a sealed and bonded baffle perimeter as shown in 44. Similar to the bonding and sealing methods disclosed above, a heat sealer can be used to create the baffles bonding 44 for the inner 41, lower 42, and upper 43 baffles used in the hydration pouch 10. In the ideal embodiment the inner baffles 41 are "bone-shaped," with a horizontal linear shaft component and spherical ends connected at each shaft end. Other shapes may be used for the inner baffles 41, depending on the intended design and needs of the hydration pouch 10.

The upper 42 and lower 43 baffles are used to store liquids and adequately distribute the weight of liquids being carried in the hydration pouch 10 at a given time. The upper baffles 42 are a symmetrical horizontal heat seal originating from each lateral side of the body 14 that runs upward from the lateral perimeter to the tapered neck 18 of the hydration pouch 10 opening 17. The lower baffles 43 resemble a concave right triangle and is also a symmetrical horizontal heat seal that runs from each lower lateral 11*b* side in a downward curve that meets in the center of the bottom 11*c* of the body 14. The placement of each lower baffle 43 distributes the weight of the hydration pouch 10 so that too much liquid doesn't accumulate at the bottom 11*c* of the containment area 16. The unique placement and design of the upper 42 and lower 43 baffles as well as the inner baffles 41 in the containment area 16 allows the hydration pouch 10 to be manufactured with inexpensive materials with minimal concern for breakage during use.

It is important to note that liquids are to be added to the hydration pouch 10 via an opening 17 at the top 11*a* of the body 14 between the first 12 and second 13 sheets. The top 11*a* of the first 12 sheet and the top of the second 13 sheet are unbounded and form an opening 17 for liquid to be added to the containment area 16. The unsealed top 11*a* of the first 12 and second 13 sheets and curved upper baffle 43 creates a opening 17 and a tapered neck 18 to allow a user to deposit a desired amount of liquid into the containment area 16 of the hydration pouch 10. When the neck 18 at the top 11*a* is separated to create an opening 18 between the first 12 and second 13 sheets, available liquids can be delivered to the pouch. The ideal amount of liquid to be held by the containment area 16 ranges between 1 and 3 liters. Once the desired amount of liquids is added, the user can seal the top 11*a* of the hydration pouch 10 via a mechanical clamp 52.

The wider opening 17 at the top 11*a* of the body 14 presents several advantages to hydration pouches 10 in the prior art. First, additional items such as ice or cooling articles may be added to liquids stored in the hydration pouch 10. Most hydration pouches 10 in the prior art require a user to store the pouch overnight in a refrigerator in order for liquids to be chilled and maintain a desired temperature. This design consideration reduces the spontaneity in which outdoor activities can be initiated. The present invention eliminates this consideration because the opening 17 eliminates the need for the pouch to be externally cooled prior to use. Users can easily place ice or other cooling articles into the hydration pouch 10 from the opening 17. Moreover, the wider mouth of the opening 17 allows a user to quickly deposit liquids into the hydration pouch without having to be slowed by a narrow opening or neck. It is also easier to add powders such as solid nutritional supplements via the opening at the top 11*a* of the hydration pouch 10 than it would with a narrow or limited opening.

Once the user has filled the hydration pouch 10 via the open neck 17 and sealed the top 11*a*, liquids from the hydration pouch 10 are delivered to the wearer via a connection valve 31 attached to the first sheet 12, a delivery tube 32 coupled at one end to the connection valve 31 and to a user accessible valve 33 at the other end. In the preferred embodiment, the connection 12 and is proximal to the hydration pouch 10. Also, in the preferred embodiment, the user accessible valve 33 is a bite valve system and is distal to the hydration pouch 10.

While the device remains ultimately disposable, a user may choose to refill the hydration pouch 10 one or more times before disposing of it. It would be advantageous for a user to maximize use of the hydration pouch 10 by using it and cleaning it on several occasions before disposing of it. A user may refill or fill a partially filled hydration pouch 10 by adding liquids to the containment area 16 via the opening 17 and neck 18 at the top 11*a* of the body 14.

In certain embodiments of the present invention, the delivery tube 32 may include a insulating means such as a delivery tube 32 cover made from neoprene, or other composition that would prevent freezing. The insulating system is important when active in winter athletic events that take place in below-freezing environments.

The user accessible valve 33 is placed into an open configuration by biting down on the valve using the jaws and teeth. Once the wearer provides sufficient vacuum-suction to facilitate transfer of liquids via the user accessible valve 33 in an open position, liquids flow from the bottom 11*c* of the hydration pouch 10 through the delivery tube 32, ultimately to the wearer's mouth. Once the wearer ceases providing sufficient vacuum-suction through the user accessible valve 33, the liquids remain available through the delivery tube 32 but are not spilled or lost because the user accessible valve 33 component remains closed. Another advantage of the bite a bottle or other cylindrical liquid storage device. Instead, the user can be actively moving or participating while simultaneously consuming liquids.

Because the delivery tube 32 can be quickly and easily separated from the hydration pouch 10, the preparation and change-out times for the hydration pouch 10 are substantially reduced. Allowing the delivery tube 32 to be detachable improves the storage of the hydration pouch 10 because a user can place or store a hydration pouch 10 without being concerned about the placement of a piece of extraneous tubing.

Figure 2A:
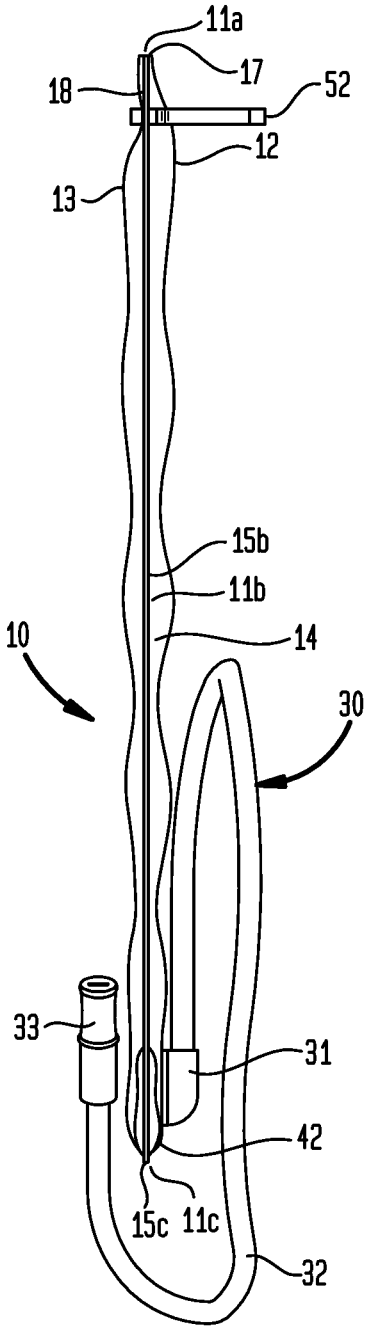
FIG. 2A is a side cross-sectional view of an unfilled disposable hydration pouch.

FIG. 2A is a side cross-sectional view of the disposable hydration pouch 10 without liquid in the containment area 16. First, the top 11*a*, lateral 11*b*, and bottom 11*c* are heated around the ends to the first 12 and second 13 sheets to create the body 14 and containment area 16 for the hydration pouch 10. Because FIG. 2A is a side view, the top 11*a* and bottom 11*c* of the hydration pouch 10 is not readily visible. At the bottom of the body 14 is the liquid delivery apparatus 30 attached to the first sheet 12 via the connection valve end 31. The connection valve end 31 includes an insert to connect one end of the delivery tube 32, which connects at the other end to the user accessible valve 33. When the delivery tube 32 is separated from the connection valve end 31, liquids are quickly expelled from the hydration pouch 10 because the connection valve end 31 is set to a open position without an inserted delivery tube 32. The delivery tube 32 can be separated from the connection valve end 31 by disconnecting it.

Liquids are added to the hydration pouch 10 by widening the opening 17 at the top 11*a* between the first 12 and second 13 sheets and then depositing liquids in the containment area 16 of the body 14. Once poured into the opening 17 and through the neck 18, the liquids will begin to accumulate at the bottom 11*c* of the containment area 16 and fill upwards if a delivery tube 32 is attached to the connection valve end 31. If the first 12 and second 13 sheets are not separated at the opening 17, then the side profile view of the apparatus resembles the Figure in FIG. 2A.

Further, in the unfilled configuration shown in FIG. 2A, the hydration pouch 10 may be rolled up for storage purposes and the liquid delivery apparatus 30 may be separated for space saving purposes. When rolled up into a compressed unfilled configuration, the likelihood that the hydration pouch 10 will be damaged during transport is reduced.

Figure 2B:
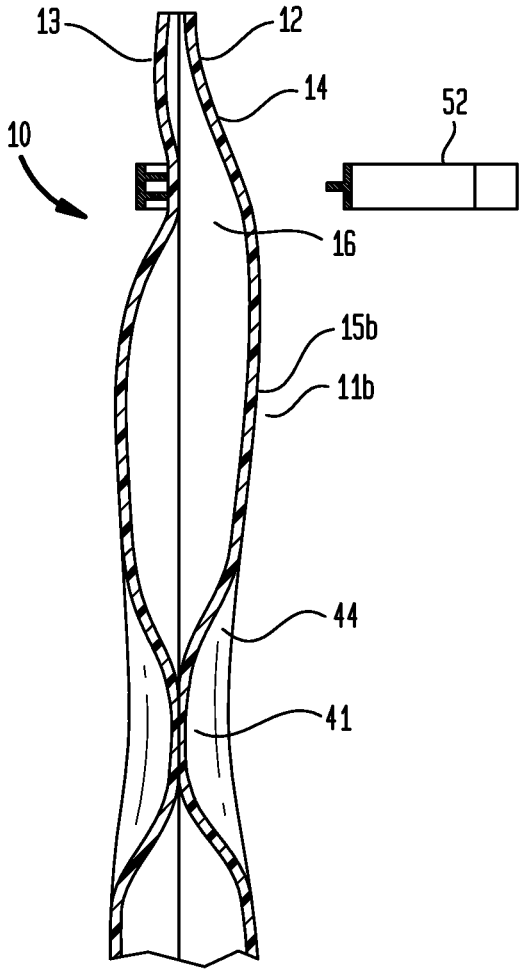
FIG. 2B is a side cross-sectional close-up view of an unfilled disposable hydration pouch of FIG. 1 taken along the line 2B-2B.

FIG. 2B shows a side cross-sectional close-up view of an unfilled disposable hydration pouch of FIG. 1 taken along the line 2B-2B. Turning our attention to the hydration pouch 10 in FIG. 2B, the inner baffle is present in 41 and the bonding and seal for the inner baffle is shown in 44. The first 12 and second 13 sheets are shown with the sealed body 14 including a containment area 16. Note that the inner baffle 41 prevents the excess lateral movement of liquid and weight thereof when the liquids are being transported during activity.

Figure 3:
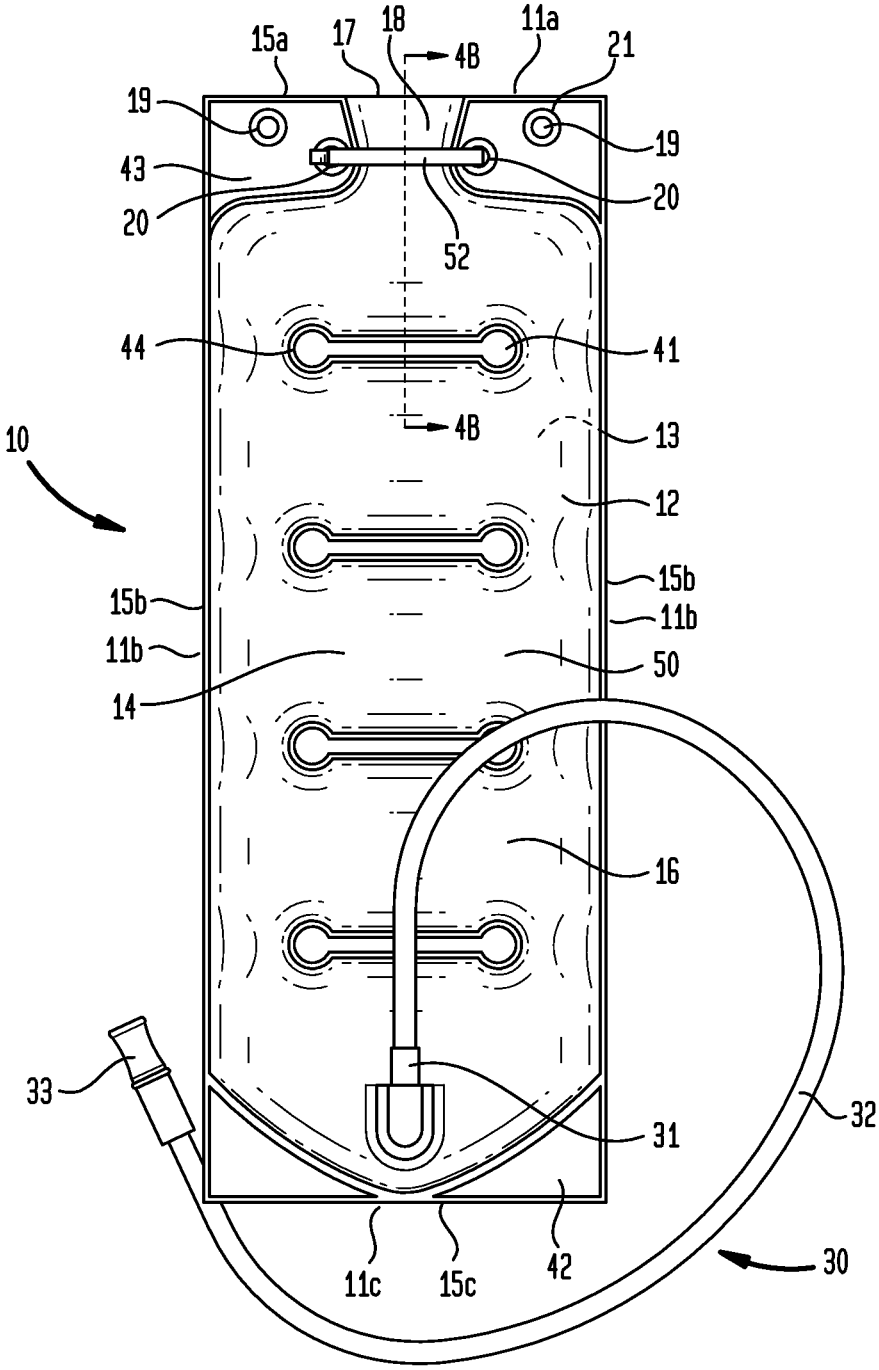
FIG. 3 is a front view of a liquid filled disposable hydration pouch.

FIG. 3 shows a front view of a disposable hydration pouch filled with liquids 50. In the filled configuration, the containment area 16 is much more pronounced compared to FIG. 1 and the body 14 of the hydration pouch 10 protrudes outward. Liquids 50 also surround the inner baffles 41, providing support to prevent excess lateral movement of the liquids 50. Note that the hydration pouch 10 is in a closed configuration at the top because it is sealed via a mechanical clamp 52.

The mechanical clamp 52 couples to the outer 19 or inner 20 annular ports located at the top 11*a* of the body 14 and also seals the opening 17 of the first 12 and second 13 sheets. The invention includes both outer 19 and inner 20 annular ports that are symmetrically placed to the lateral ends 11*b* of the hydration pouch 10. The mechanical clamp 52 acts as a hangar and serves to connect and hang the hydration pouch 10 to another apparatus such as the top of an inner pocket of a backpack or bag. Specifically, the mechanical clamp 52 couples to the inner 20 annular ports of the hydration pouch 10 located at the top 11*a* of the body 14. Based on the desired use, a user may wish to use the outer 19 annular ports located at the top 11*a* of the body 14 to better stabilize the hydration pouch 10. Once the hydration pouch 10 is able to hang from a backpack inner pocket or body and the user accessible valve 33 and delivery tube 32 is available to a user's mouth, the hydration system can be used. By hanging the hydration pouch 10 via the mechanical clamp 52, liquids can be efficiently delivered to a user during activity.

Liquids 50 are delivered to the user via the liquid delivery apparatus 30 by placing the user accessible valve 33 into an open configuration through biting the valve 33 and providing vacuum-suction. Once the user provides sufficient vacuum-suction from the user accessible valve 33 to facilitate transfer of liquids 50 via the delivery tube 32, liquids 50 flow from the bottom 11*c* of the hydration pouch 10 through the delivery tube 32 and user accessible valve 33 to the user's mouth. Once the user ceases providing sufficient vacuum-suction through the user accessible valve 33, the liquids remain available through the delivery tube 32 but are not spilled or lost because the user accessible valve 33 component remains closed once the user ceases biting the user accessible valve 33. To prevent loss of liquids 50 the default position for the user accessible valve 33 is closed. However, if the liquid delivery apparatus 30 is disengaged from the connection valve end 31, then liquids 50 are quickly expelled from the hydration pouch 10 via the open connection valve end 31.

Figure 4A:
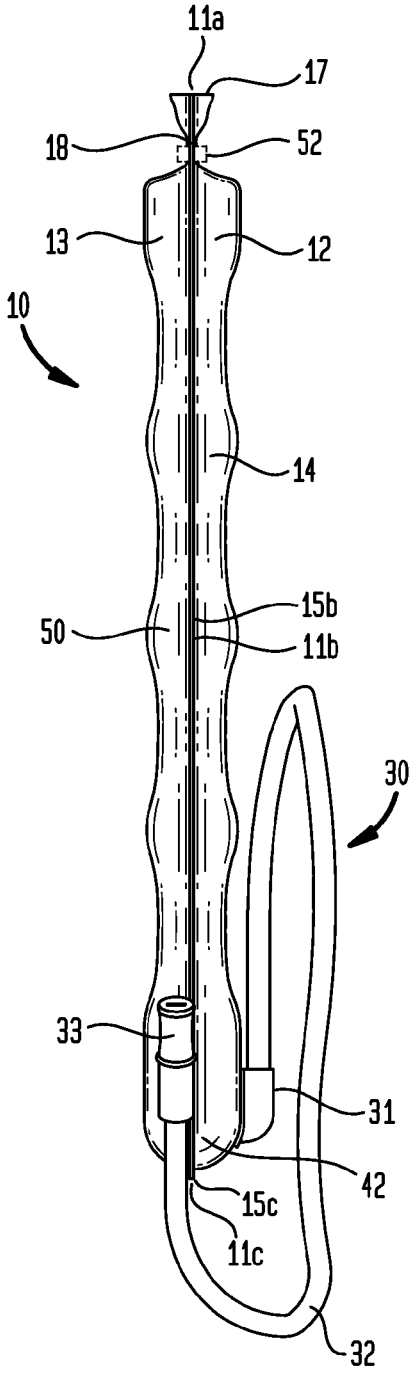
FIG. 4A is a side cross-sectional view of a liquid filled disposable hydration pouch.

FIG. 4A is a side cross-sectional view of the disposable hydration pouch 10 with liquids 50 in the containment area 16. Because FIG. 4A is a side view, the top 11*a* and bottom 11*c* of the hydration pouch 10 is not readily visible. At the bottom of body 14 is the liquid delivery apparatus 30 attached to the first sheet 12 via the connection valve end 31. The connection valve end 31 includes an insert to connect one end of the delivery tube 32, which connects at the other end to the user accessible valve 33. Similarly, when the delivery tube 32 is separated from the connection valve end 31, liquids 50 are quickly expelled from the hydration pouch 10 because the connection valve end 31 is set to an open position without an inserted delivery tube 32.

Liquids 50 are added to the hydration pouch 10 by widening the opening 17 at the top 11*a* between the first 12 and second 13 sheets and then adding liquids 50 to the containment area 16 of the body 14. Once poured into the opening 17 and through the neck 18, the liquids 50 accumulate at the bottom 11*c* of the containment area 16 and fill upwards if a delivery tube 32 is attached to the connection valve end 31. If the first 12 and second 13 sheets are not separated at the opening 17, then the side profile view of the apparatus resembles the Figure in FIG. 4A.

Figure 4B:
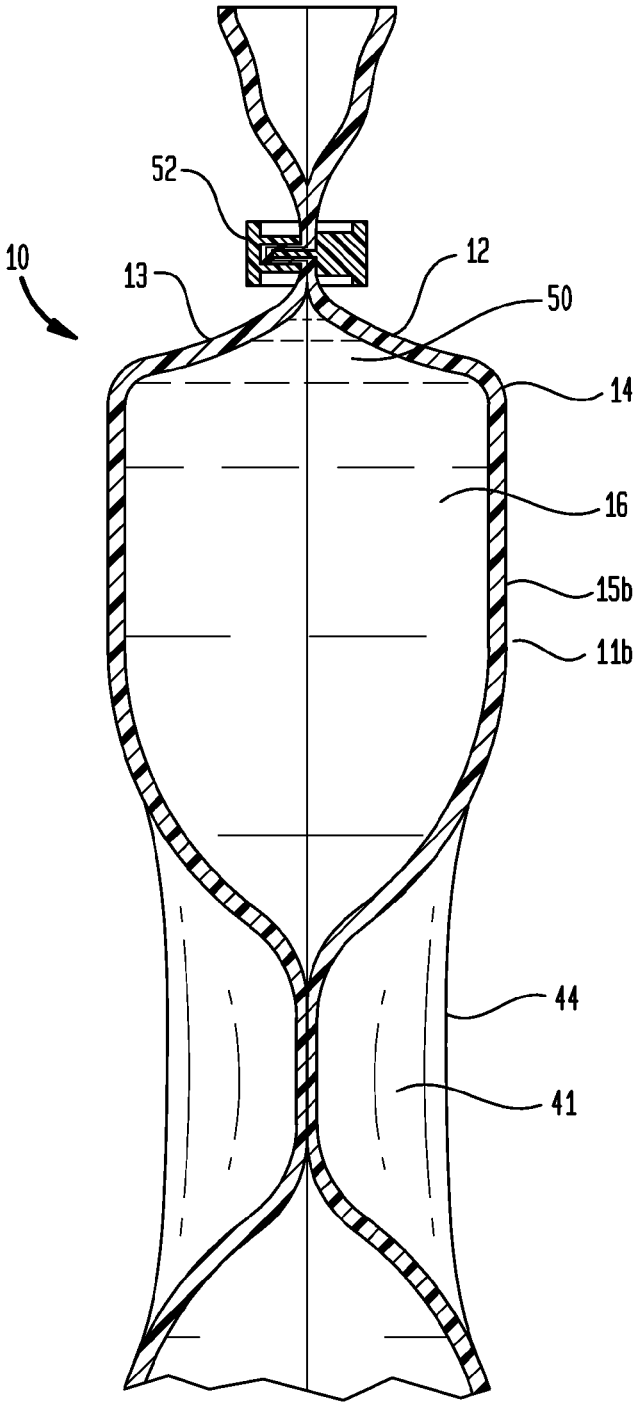
FIG. 4B is a side cross-sectional close-up view of a liquid filled disposable hydration pouch of FIG. 3 taken along the line 4B-4B.

FIG. 4B shows a side cross-sectional close-up view of a liquid filled disposable hydration pouch of FIG. 3 taken along the line 2B-2B. The first 12 and second 13 sheets making up the body 14 containment area 16 between the sheets. The lateral bonding 15*b* and sides 11*b* provide support and a shape for the liquid 50 to fill into the hydration pouch 10. In the hydration pouch 10 of FIG. 4B, the inner baffle is present in 41 and the bonding and seal for the inner baffle is shown in 44. The first 12 and second 13 sheets are shown with the sealed body 14 including an expanded containment area 16 as a result of the added liquids 50. Note that the position of the inner baffle 41 prevents the excess lateral movement of liquids 50 and weight thereof when the liquids are being transported during activity.

While a particular embodiment of the invention has been described and disclosed in the present application, it is clear that any number of permutations, modifications, or embodiments may be made without departing from the spirit and the scope of this invention. Accordingly, it is not the inventor's intention to limit this invention in the present application, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

In light of the above "Detailed Description," Inventors may make changes to the invention. While the detailed description outlines possible embodiments of the invention and discloses the practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A disposable hydration pouch system for reducing lateral movement of stored liquids during gait, said pouch comprising:

a first sheet and a second sheet of poly-ethylene disposed adjacent to one another, wherein said first sheet and said second sheet are rectangular shaped and sealed together via a heat sealing means to create an outer perimeter and a reservoir at the bottom side and lateral ends, and an opening at the top of the pouch, said opening comprising a tapered neck that widens outward into said reservoir and one or more upper baffles sealed together via a heat sealing means, said reservoir comprising one or more inner baffles sealed together via a heat sealing means between said first sheet and said second sheet and arranged equidistant and parallel to the top and bottom of said pouch, wherein the shape of the inner baffles further comprise a shaft with ends, wherein said ends are circular shaped and taper inward onto said shaft, one or more lower baffle seals shaped as concave right triangles and sealed together via a heat sealing means located near the bottom of said pouch, and a second opening in said first sheet of said pouch substantially near the center of the base of said pouch with a connector valve placed into said second opening of said pouch, said connector valve comprising a securing means to fasten said connector valve to said pouch and a delivery tube with a proximal end and a distal end, said proximal end of said delivery tube coupled to said connector valve, and said distal end of said delivery tube coupled to a user accessible valve; and a mechanical clamp.

2. The disposable hydration pouch of claim 1, wherein said user accessible valve is a bite valve.

3. The disposable hydration pouch of claim 1, wherein said pouch further comprises a plurality of symmetrical and equally sized annular ports sealed at or near the top of said pouch.

4. The disposable hydration pouch of claim 1, wherein said delivery tube further comprises an insulation covering placed concentrically around said delivery tube.

5. The disposable hydration pouch of claim 1, wherein said mechanical clamp further comprises a hangar that couples said pouch to a supporting apparatus.

* * * * *